United States Patent [19]

Bledsoe

[11] 3,959,851

[45] June 1, 1976

[54] COTTON GINNING APPARATUS

[76] Inventor: Woodrow W. Bledsoe, 2775 Dalewood, Memphis, Tenn. 38127

[22] Filed: June 30, 1975

[21] Appl. No.: 592,067

[52] U.S. Cl. ..... 19/48 A
[51] Int. Cl.[2] ..... D01B 1/04
[58] Field of Search ..... 19/48–56, 19/203, 202, 57, 58

[56] References Cited

UNITED STATES PATENTS

| | | | |
|---|---|---|---|
| 1,490,915 | 4/1924 | Cross et al. | 19/50 |
| 1,767,894 | 6/1930 | Petty et al. | 19/55 R |
| 1,880,934 | 10/1932 | Elliott | 19/57 X |
| 3,231,939 | 2/1966 | Deems | 19/55 R |
| 3,543,350 | 12/1970 | Malkov | 19/50 |

*Primary Examiner*—Dorsey Newton
*Attorney, Agent, or Firm*—John R. Walker, III

[57] ABSTRACT

A cotton ginning apparatus having a rotating ginning saw drum for engaging and holding the fibers of the seed cotton. A cylinder-like serrated kicker device extends across the path of the seed cotton being admitted for directing the seed cotton onto the ginning saw cylinder. The seed cotton, being held upon the ginning saw cylinder, is brought into engagement with a rotating spiral shaped gin roller. The gin roller has several spiral conveyor-like vanes which respectively have left and right-hand twists thereto that terminate midway between the outer ends thereof. The gin roller rotates with a greater surface velocity than that of the ginning saw cylinder, thus a lateral wiping action acts upon the seed cotton while the teeth of the ginning saw cylinder have a continuous pull on the fibers. The wiping action of the gin roller and the ever present pull on the fibers separates the seeds from the fiber, i.e., the removed seeds being carried inwardly to the center of the gin roller for discharge therefrom. The seeds which are being discharged from the gin roller may either pass through finger-like grid structure disposed adjacent the kicker device or they may be carried between the kicker device and the ginning saw by the kicker device for ultimate discharge. The lint fiber continues to rotate with the teeth of the ginning saw drum to a discharge point where a rotating cylinder-like brush device doffs the lint fiber from the saw teeth for ultimate discharge.

12 Claims, 4 Drawing Figures

COTTON GINNING APPARATUS

BACKGROUND OF THE INVENTION

1. Field of the Invention

This invention relates to the field of cotton ginning devices and is particularly directed toward ginning devices which incorporate means for pneumatically conveying the cotton into the ginning apparatus.

2. Description of the Prior Art

Conventional cotton gins have arcuate ginning ribs extending between the individual saws, which jointly constitute the ginning saw drum. The spacing between each of the saws is sufficient to permit seeds to pass between the individual saws to escape from the ginning area. For example, like the ginning ribs shown on page 52 of a handbook entitled "Handbook for Cotton Ginners" published by the Agricultural Research Service of the United States Department of Agriculture and further identified as Agricultural Handbook No. 260. More specifically, this prior type of saw drum utilizes the space between the individual saw members for carrying the seeds. Accordingly, these prior type saw drums were restricted to disk type circular saws having spacers therebetween, i.e., as opposed to garnet wire wrap type saw drums which simply have a barbed garnet wire convolutely wound about a drum.

SUMMARY OF THE INVENTION

The concept of the present invention is to provide apparatus for removing seeds from seed cotton. The apparatus of the present invention may be of a permanent installation or it may be portable. More specifically, the complete system might be factory assembled and shipped as a unit, or the complete unit might be mounted on suitable wheels, a trailer, or truck to facilitate being transported to the cotton field for total processing of the cotton in the field.

The cotton ginning apparatus of the present invention includes a rotating ginning saw drum for engaging and holding the fibers of the seed cotton. A cylinder-like serrated kicker device extends across the path of the seed cotton being admitted for directing the seen cotton onto the ginning saw cylinder. The seed cotton, being held upon the ginning saw cylinder, is brought into engagement with a rotating spiral shaped gin roller. The gin roller has several spiral conveyor-like vanes which respectively have left and right-hand twists thereto that converge substantially midway between the outer ends thereof. The gin roller rotates with a greater surface velocity than that of the ginning saw cylinder, thus a lateral wiping action acts upon the seed cotton while the teeth of the ginning saw cylinder have a continuous pull on the fibers. The wiping action of the gin roller and the ever present pull on the fibers separates the seeds from the fibers, i.e., the removed seeds being carried inwardly by the several vanes to the center of the gin roller for discharge therefrom. The seeds being discharged from the gin roller may either pass through finger-like grid structure disposed adjacent the kicker device or they may be carried between the kicker device and the ginning saw by the kicker device for ultimate discharge. The lint fiber continues to rotate with the teeth of the ginning saw drum to a discharge point where a rotating cylinder-like brush device doffs the lint fibers from the saw teeth for ultimate discharge.

An important feature of the present invention is that the ginning action is accomplished entirely on the surface of the rotating ginning saw drum. Therefore, the saws on the saw drum may be either disk type with spacers or garnet wire wrap. It should be mentioned that in either type the preferred spacing between convolutions or individual disk saws is approximately ⅛ in. or 3.175 mm from center to center. Another very important feature of the cotton gin of the present invention is the spiral gin roller which rotates in the same direction as the ginning saw drum. The significance of the spiral ginning roller is in the lateral wiping action thereof which provides superior seed removal results. Another important feature of the spiral ginning roller is the deflecting action of the helical flights, i.e., the helical flights or vanes deflect the removed seeds inwardly toward the converging left and right-hand twists thereto. It will be appreciated by those skilled in the art that greater effectiveness is achieved by deflecting the seeds away from the direction of the movement of the fibers, i.e., while the fibers are impaled upon the tooth structure of the saw drum, the lateral wiping action of the spiral ginning roller separates the seeds from the fibers. This is believed to be a totally new concept in cotton ginning. In fact, it is believed that this new concept in cotton ginning will result in cotton being totally processed in the cotton field, as opposed to being transported to a centrally located factory-like cotton gin.

Another important feature of the cotton gin of the present invention is the introduction of the means for final air washing of the cotton fibers that are being held on the saw drum. This feature provides for much cleaner cotton by removing any remaining trash, motes or remaining seeds. In other words, by forcing air through nozzles at a high velocity onto the saw drum, counter to the direction of the moving cotton fibers, considerable force is exerted on the cotton fibers resulting in trash, motes, or remaining seeds, being separated from the cotton fibers. The removed particles are entrained into the airstream and carried to the finger-like grid structure for ultimate discharge through an exhaust duct.

The ginned seeds, i.e., those which have been separated from the fiber, fall back to the serrated kicker device and as a result of the agitation of the revolving kicker device are separated from the incoming cotton that is being directed to the teeth of the saw drum. A seed channel is provided for conveying the removed seeds to a screw conveyor which discharges the seeds from the apparatus. It should be emphasized that the air washing principle is a lint fiber cleaning system and may be used independent of the cotton ginning operation.

It should be pointed out that the cotton gin of the present invention is intended to normally receive the seed cotton from a seed cotton cleaning apparatus which may be situated either at the cotton field or at a centrally located permanent installation. Further, it may be desirable to first pass the comingled seed cotton and trash through a cotton drier, i.e., in the event the moisture content is higher than optimum conditions commensurate with the cleaning process. Therefore, it is anticipated that suitable cotton drying apparatus may be situated at either the cotton field or at a centrally located permanent installation.

DESCRIPTION OF THE PREFERRED EMBODIMENT

Figure 1:
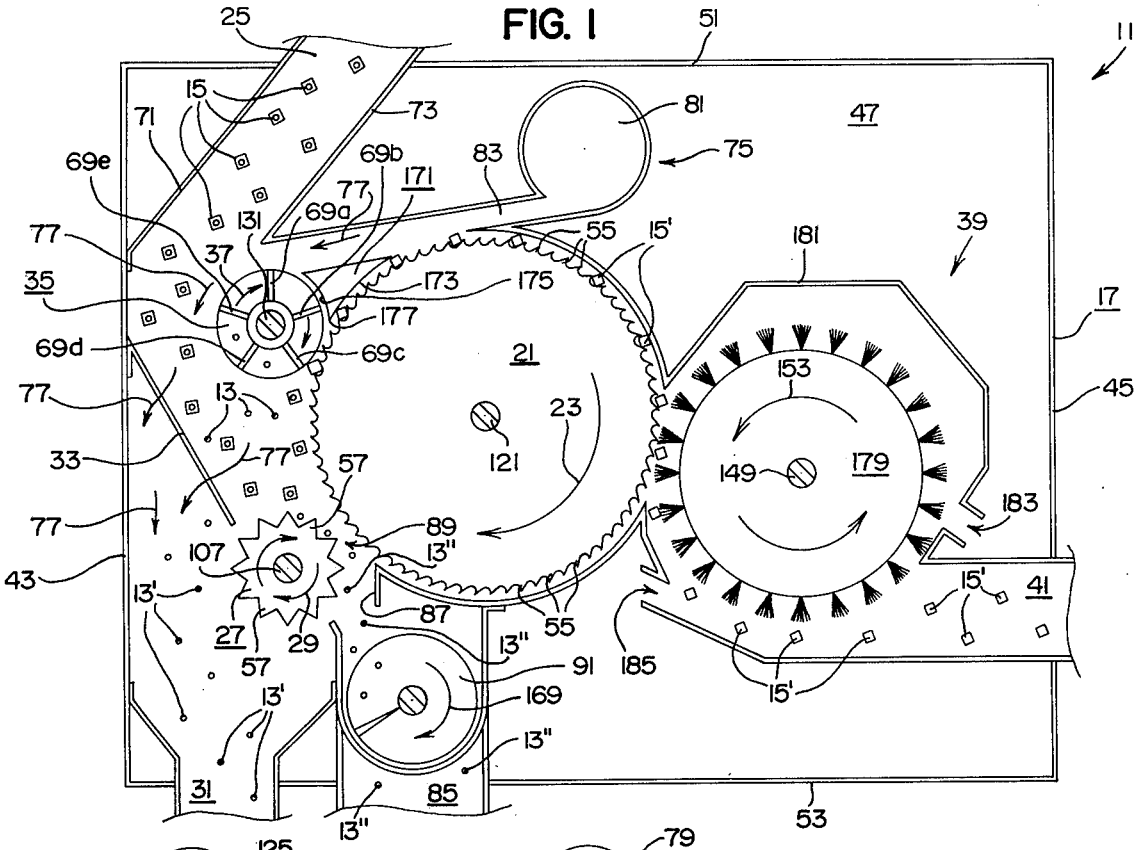
FIG. 1 is a sectional view of the cotton ginning apparatus of the present invention with the view being taken as on a vertical plane so as to effectively remove one side panel thereof.

The apparatus 11 of the present invention is intended for removing and segregating seeds, characterized herein by the numeral 13, from seed cotton, characterized herein by the numeral 15. The apparatus 11 includes frame-like housing means 17 which supports a prime mover 19 for rotatably driving certain structure of the apparatus 11. A ginning saw cylinder, as at 21, is included for engaging and holding the fibers of the seed cotton 15. The ginning saw cylinder 21 is journaled to the housing 17 and is coupled to the prime mover 19 for rotation in a predetermined direction about a horizontal axis, i.e., in the direction of an arrow 23. the housing 17 is provided with entry duct means, as at 25, disposed adjacent the ginning saw cylinder 21 for admitting the seed cotton 15 therein. Disposed within the housing 17 is cylinder-like serrated kicker means 27 which extends across the path of the seed cotton 15, being admitted into the housing 17, for agitating and directing the seed cotton 15 onto the ginning saw cylinder 21. The serrated kicker 27 is journaled to the housing means 17 and is coupled to the prime mover 19 for rotation in a predetermined direction about a horizontal axis, i.e., in the direction of an arrow 29. Leading outwardly from the housing means 17 is first outlet duct means, as at 31, for receiving and discharging at least a first portion of the seeds which have been removed from the seed cotton 15, i.e., the first portion of seeds may hereinafter be further characterized by the numeral 13'. Interposed between the entry duct means 25 and the first outlet duct means 31 are finger-like grid means 33 for preventing passage into the first outlet duct means 31 of the locks of cotton 15 and for permitting passage therethrough of the segregated seeds 13'. Coacting with the ginning saw cylinder 21 is spiral shaped ginning roller means 35 for engaging and removing the seeds 13 from the seed cotton 15. The ginning roller 35 is journaled to the housing means 17 and is coupled to the prime mover 19 for rotation in a predetermined direction about a longitudinal axis, i.e., in the direction of an arrow 37. The rotating axis of the ginning roller 35 is precisely positioned with respect to the ginning saw cylinder 21 whereby the periphery of the ginning roller 35 is a predetermined distance from the periphery of the ginning saw cylinder 21 thus enabling the ginning roller 35 to effectively engage and pull the seeds 13 from the seed cotton 15, i.e., the ginning saw cylinder 21 is continuously pulling on the seed cotton 15 while the spiral shaped ginning roller is continually offering a lateral wiping action upon the seed cotton 15. Also included are doffing means 39 for subsequently removing the lint cotton from the ginning saw cylinder 21, i.e., the lint cotton may hereinafter be specifically characterized by the numeral 15'. The apparatus 11 also includes lint cotton duct means 41 leading outwardly from the housing 17 for receiving the lint cotton 15' from the doffing means 39 and for directing the lint cotton 15' to further processing apparatus, e.g., a cotton baler (not shown) or other apparatus well known to those skilled in the art.

The housing means 17 includes a front panel 43 and a rear panel 45 which are joined one to the other by a pair of side panel members 47, 49. The upper ends of the vertically disposed panels 43, 45, 47, 49 are joined one to the other by a top panel member 51 and the lower ends thereof are joined one to the other by a bottom panel 53. Therefore, the interior of the housing means 17 is sealably enclosed from without.

The ginning saw cylinder 21 may be either the well-known disk type with spacers between individual circular disk saws or it may be the garnet wire wrap type which simply has convolutions of a wire, having miniature barbs, wound about a drum. In either type, the spacing between the individual disks or the individual convolutions should be approximately ⅛ in. (3.175 mm) from center to center. Therefore, the seeds 13, being larger than this spacing, will not enter between the individual saw disks. The ginning saw cylinder depicted in FIG. 1 of the drawings is intended to represent either of the above types. Accordingly, the circumferential surface of the ginning saw cylinder 21 is substantially covered with slanted teeth, as at 55, which it may clearly be seen have the pointed ends thereof pointed in the direction of rotation, i.e., in the direction of the arrow 23.

Ginning saw cylinders of the variety having circular disk saws are shown in U.S. Pat. No. 1,118,412, issued Nov. 24, 1914 to J. W. Graves. Accordingly, the above brief description of the ginning saw cylinder 21 will suffice for present purposes, reference should be made to the Graves patent for a more detailed description of the character and structure of the ginning saw cylinder 21.

From FIG. 1 of the drawings it may clearly be seen that the cylinder-like serrated kicker means 27 is smaller in diameter than the ginning saw cylinder 21. In this regard, it should be mentioned that the kicker 27 is constructed so as to be somewhat similar to the ginning saw cylinder 21. In other words, the circumferential surface of the kicker 27 is substantially covered with a plurality of teeth, as at 57. However, it will be noted that the teeth 57 are considerably larger than the teeth 55. Moreover, the teeth 57 are unlike the teeth 55 since the teeth 57 are substantially radially aligned or are not slanted in the direction of rotation. From FIG. 3 of the drawings it may clearly be seen that the serrated kicker means 27 includes a plurality of circular disk saws 59 which are individually designated as **59*a*, 59*b*, and 59*c*, etc. Further, the serrated kicker 27 includes a plurality of spacer members alternately spaced between the individual saws 59*a*, 59*b*, 59*c*, etc., e.g., like that taught in the above-referenced Graves patent. The preferred spacing between the disks 59 ranges from ⅛ in. to 3/16 in. (3.175 mm to 4.7625 mm) to permit the passage therebetween of air and small trash particles and to preclude passage therebetween of the cotton seeds 13.**

Figure 3:
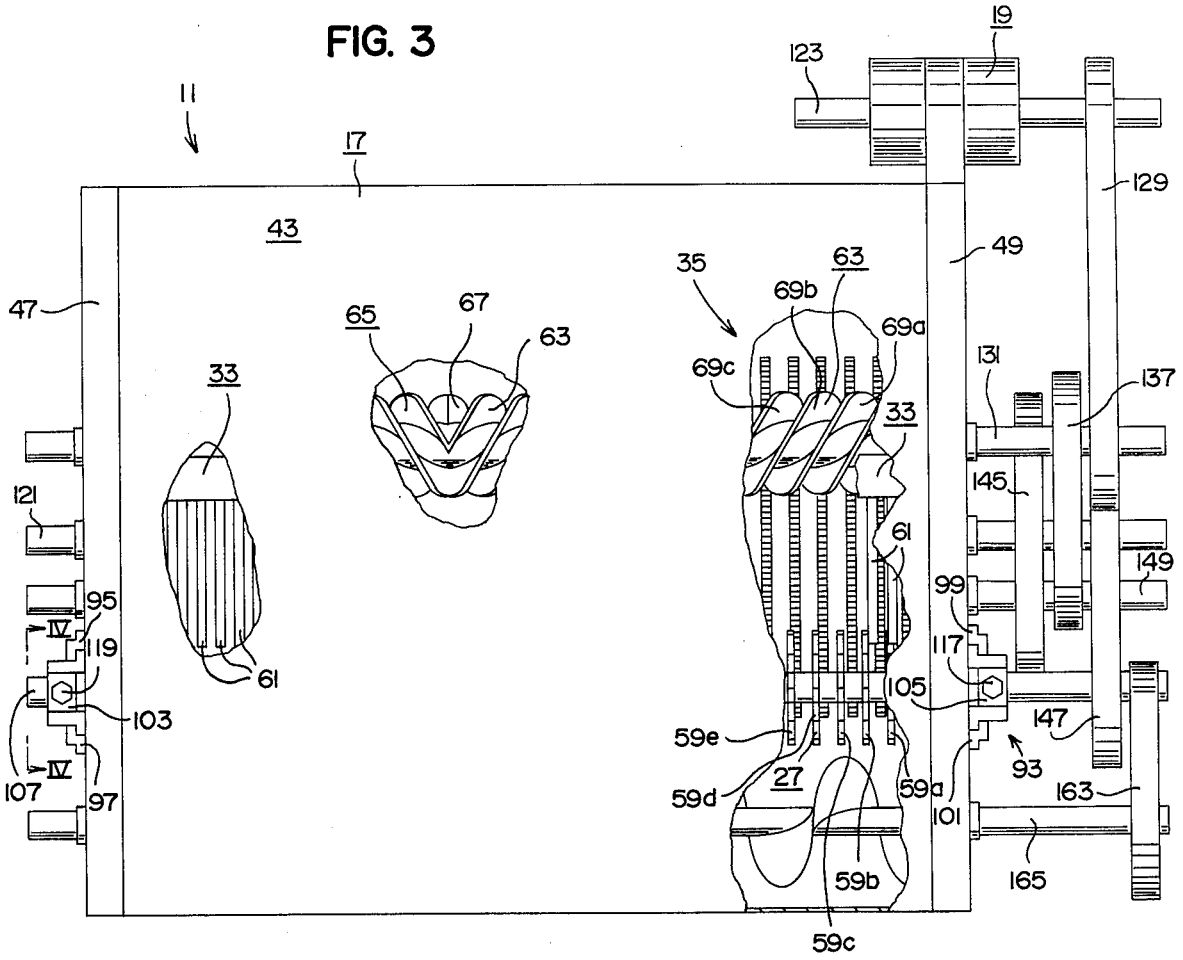
FIG. 3 is a front elevational view of the cotton ginning apparatus of the present invention showing portions thereof broken away to clearly illustrate certain internal structure.

From FIGS. 1 and 3 of the drawings it may clearly be seen that the finger-like grid means 33 includes a plurality of finger or rodlike members 61 having one of the respective ends thereof fixedly attached to the front panel 43 and the free ends thereof pointing downwardly toward the serrated kicker 27 and terminating adjacent thereto as indicated in FIG. 1. The spacing between the rodlike members 61 is not critical, since the object of the grid means 33 is to prevent passage into the first outlet duct means 31 of the licks of cotton 15 and to permit passage therethrough of the segregated seeds 13', i.e., these seeds are free of lint fibers.

From the removed portions in FIG. 3 of the drawings it may clearly be seen that the spiral shaped ginning roller means 35 includes a left-hand twist assembly 63 and a right-hand twist assembly 65, i.e., the left and right-hand twist assemblies 63, 65 terminating substantially midway between the ends of the roller 35 at a mid portion characterized by the numeral 67. Each of the left and right-hand twist assemblies, 63, 65 preferably includes a plurality of individual continuous vanes characterized by the numeral 69 and individually designated as 69*a*, 69*b*, 69*c*, etc., as best shown in FIG. 1 of the drawings, i.e., the assemblies 63, 65 are staggered to permit seeds to discharge from each.

The doffing means 39 may be of the well-known revolving type brush roller of the type similar to that shown on pages 40 through 43 of the previously mentioned Argicultural Handbook No. 260. Therefore, a brief description of the doffing means 39 will suffice for present purposes; reference should be made to the above-mentioned handbook for a more detailed description of the character and structure of the preferred doffing means 39. It should be understood that other well-known means for detaching the lint cotton 15' from the saw cylinder 21 may alternately be employed. Also, various modifications and changes may be made in the character and form of doffing means 39 herein disclosed without departing from the true spirit of the invention. For example, the lint cotton 15' might be doffed from the saw cylinder 21 by a suitably directed blast of air or other structure well known to those skilled in the art.

The entry duct means 25 includes deflector means or plate-like structure as at 71, 73 for deflecting the locks of seed cotton 15 entering the entry duct means 25 to cause the locks of seed cotton 15 to move along a path prescribed by the plate-like structure 71, 73 to the ginning saw cylinder 21. The deflector means 71, 73 are effective to cause the prescribed path of the locks of cotton 15 to be disposed adjacent the front plate member or front panel 43 and at a spaced distance away from the ginning saw cylinder 21, thus precluding co-adunation of the incoming seed cotton 15 with the seed free lint cotton 15' being held by the ginning saw cylinder 21.

The apparatus 11 includes air pressure wash means, as at 75, for disloging certain foreign material, e.g., fine pepper dust or trash and the like, from the seed free lint cotton 15' being held by the ginning saw cylinder 21. The air pressure wash means 75 establishes a mass of rushing air, i.e., moving in the direction of arrows as at 77, for aiding in conveying the seed cotton 15 along the above-mentioned prescribed path and for aiding in conveying the first portion of the seeds 15' through the finger-like grid means 33 for ultimate discharge outwardly through the first outlet duct means 31.

The air pressure wash means 75 includes a source of air pressure, e.g., a motor driven air pump 79 (FIG. 2) or the like, manifold means, as at 81 (FIG. 1), communicated with the air pump 79, and nozzle means, as at 83 (FIG. 1), communicated with the manifold means 81. From FIG. 1 of the drawings it may clearly be seen that the nozzle means 83 is arranged to direct the air, shown by the arrows 77, emanating therefrom against the circumferential surface of the ginning saw cylinder 21 whereby the locks of seed free cotton 15' being held thereon are air washed. It may be seen that the flow of air from the nozzle means 83 is directed to flow in a direction which is opposite from the direction of travel, i.e., indicated by the arrow 23, of the circumferential surface of the ginning saw cylinder 21.

The apparatus 11 also includes second outlet duct means 85 leading outwardly from the housing means 17 for discharging at least a second portion of the seeds which have been removed from the seed cotton 15, the second portion of the seeds may hereinafter be specifically referenced by the numeral 13''. From FIG. 1 of the drawings it may also be seen that the apparatus 11 includes bypass means 87 communicated with the second outlet duct means 85 for receiving the second portion of the segregated seeds 13'' from the kicker means 27 and for introducing these seeds 13'' to the second outlet duct means 85. Further, it may be seen that the kicker means 27 is disposed a predetermined spaced apart distance from the ginning saw cylinder 21 with the generatrices thereof jointly defining at least in part an elongated gap, as at 89, the gap 89 extending the distance between the side panel members 47, 49. Further, it may be seen that the bypass means 87 is disposed subjacent to and communicated with the elongated gap 89 whereby the loose seeds 13'' which enter into the gap 89 gravitate downwardly between the ginning saw cylinder 21 and the kicker means 27 thus entering the bypass means 87 for ultimate discharge through the second outlet duct means 85.

The apparatus 11 also includes screw conveyor means 91 disposed adjacent the bypass means 87 for laterally moving the second portion of seeds 13'' into the second outlet duct means 85. The screw conveyor means 91 is journaled to the side panel members 47, 49 and is suitably coupled to the prime mover 19 for rotation in a predetermined direction about a horizontal axis. A preferred arrangement for coupling the screw conveyor means 91 to the prime mover 19 will be disclosed later in the specification.

Figure 4:
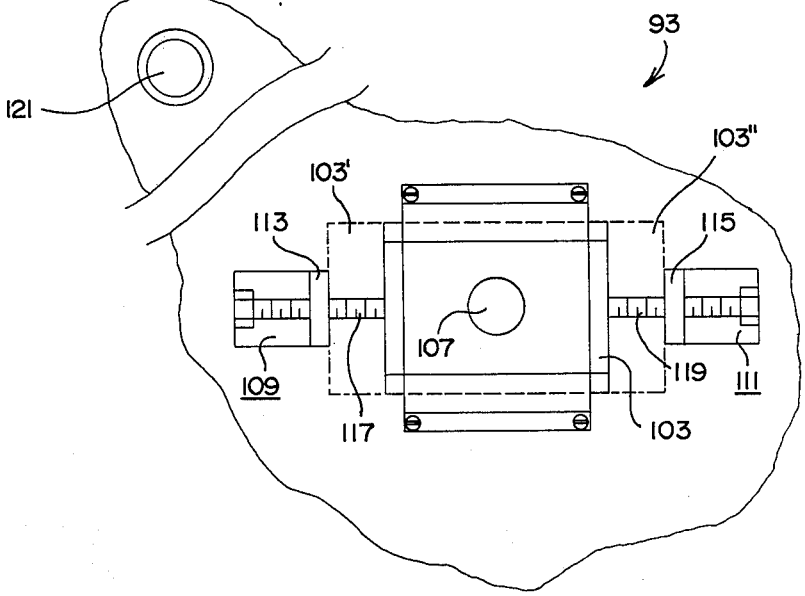
FIG. 4 is a partial sectional view taken as on the line IV—IV of FIG. 3 showing track-line structure for adjusting the effectiveness of the serrated kicker device.

From FIGS. 3 and 4 of the drawings it may clearly be seen that the apparatus 11 includes means, as at 93, for adjusting the effectiveness of the serrated kicker means 27 or, more specifically, for adjusting the width of the elongated gap 89. Thus, permitting or facilitating optimum regulation for various types and sizes of seeds 13 which pass between the ginning saw cylinder 21 and the kicker means 27. The means 93 preferably includes a pair of confrontingly arranged track members 95, 97 fixedly attached to the side panel member 47 and a substantially identical pair of confrontingly arranged track members 99, 101 fixedly attached to the side panel member 49. A pair of bearing blocks 103, 105 slidably engage the respective track members 95, 97; 99, 103, i.e., the kicker means 27 having a rotatable shaft 107 which is carried by the bearing blocks 103, 105 in a manner well known to those skilled in the art. Accordingly, slidably moving the bearing blocks 103, 105 to and fro along their respective track members 95, 97; 99, 103 is effective to vary the width of the elongated gap 89.

The means 93 for adjusting the effectiveness of the kicker 27 also includes two pair of confrontingly arranged L shaped bracket assemblies 109, 111, i.e., one pair of bracket assemblies 109, 111 being fixedly attached to the side panel member 47 and another substantially identical pair of bracket assemblies 109, 111 being fixedly attached to the panel member 49. Accordingly, since both of the pairs of bracket assemblies 109, 111 are identical, only one pair will be shown in detail, as in FIG. 4 of the drawings. The L shaped bracket assemblies 109, 111 respectively include a pair of confrontingly arranged flange-like members 113, 115 which respectively are provided with threaded apertures (not shown). The bracket assemblies 109, 111 respectively include a pair of bolt-like members 117, 119 which are threadedly received in the apertures (not shown) provided in the flange members 113, 115. The bolt members 117, 119 are arranged so that the ends thereof resting bear against opposite sides of the bearing block 103. Therefore, it may readily be seen that turning the bolt members 117, 119 in one direction is effective to slidably move the bearing block 103 to a position character referenced by the numeral 103'. Conversely, turning the bolt members 117, 119 in an opposite direction is effective to slidably move the bearing block 103 in the opposite direction or to a position character referenced by the numeral 103''. The ginning saw cylinder 21 includes a rotatable shaft 121 which is shown in FIGS. 1 through 4 of the drawings. From FIG. 4 of the drawings it may be seen that moving the bearing block to the position 103' is effective in decreasing the distance between the shafts 107, 121, thus decreasing the width of the elongated gap 89. Conversely, slidably moving the bearing block to the position 103'' increases the distance between the shafts 107, 121 thus increasing the width of the elongated gap 89.

Figure 2:
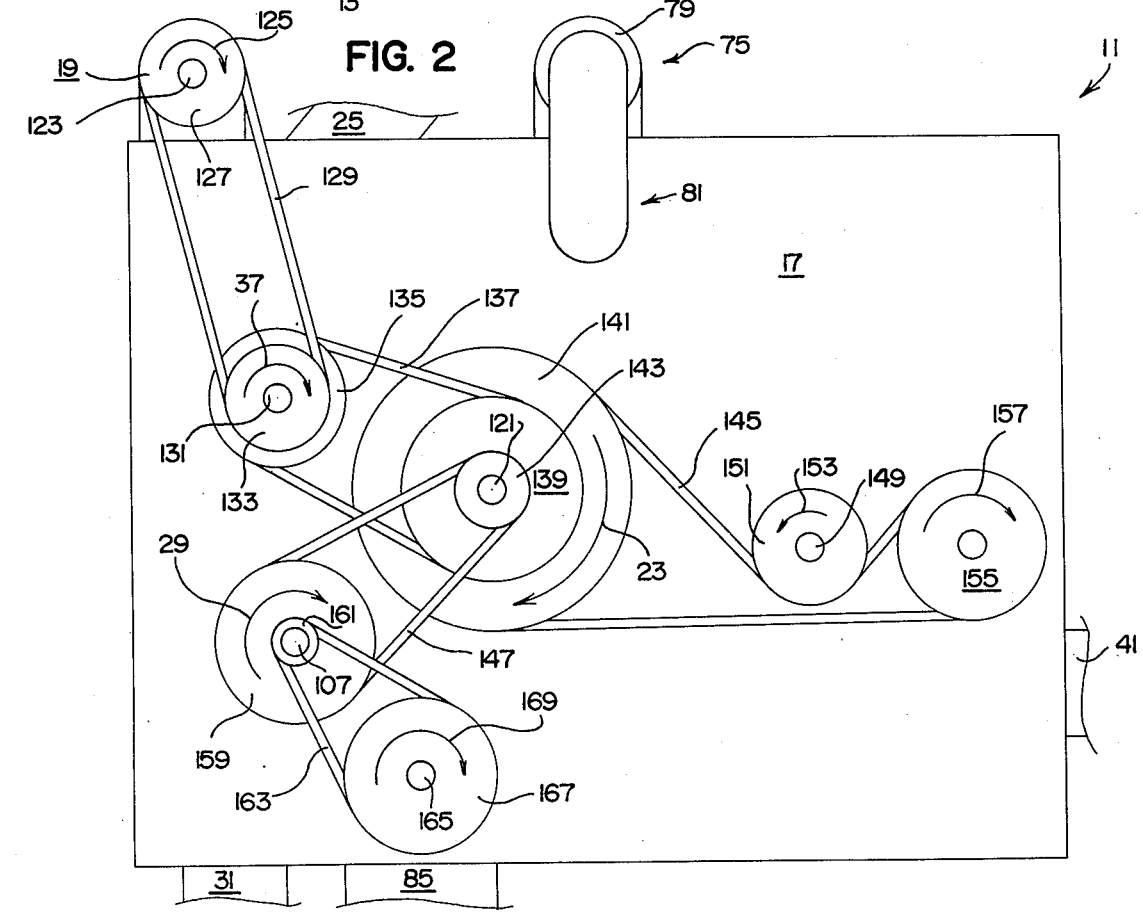
FIG. 2 is a view similar to FIG. 1 with a view being taken prior to the side panel being removed to show the preferred arrangement of certain drive structure.

Particular attention is now directed toward FIG. 2 of the drawings wherein it may be seen that the prime mover 19 includes a rotatable shaft 123 which is rotatably driven in the direction of an arrow 125. Coupled to the shaft 123 is a pulley device 127 which drives an endless belt 129. The ginning roller means 35 includes a rotatably driven shaft 131 and a pulley device 133 fixedly attached thereto, i.e., the pulley device 133 is rotatably driven in the direction of the arrow 37 by the belt structure 129. A second pulley device 135 is fixedly attached to the shaft 131 and which drives an endless belt 137.

The previously mentioned shaft 121 is rotatably driven by a pulley device 139 fixedly attached thereto, i.e., the pulley device 139 is rotatably driven in the direction of the arrow 23 by the endless belt 137. A second pulley device 141 is fixedly attached to the shaft 121 and is rotatably driven in the direction of the arrow 23 by the shaft 121. A third pulley device 143 is fixedly attached to the shaft 121 for rotation therewith in the direction of the arrow 23. The pulley device 141 drives an endless belt 145 and the pulley device 143 drives an endless belt 147.

The doffing means 39 includes a rotatable shaft 149. Fixedly attached to the shaft 149 is a pulley device 151 which is rotatably driven in the direction of an arrow 153 by the endless belt 145 as clearly shown in FIG. 2. An idler pulley 155 is rotatably attached to the side panel member 17 for rotation in the direction of an arrow 157, i.e., being rotatably driven by the endless belt 145 in the manner shown in FIG. 2. The kicker means 27 includes a pulley device 159 which is fixedly attached to the shaft 107 and which is rotatably driven in the direction of the arrow 29 by the endless belt 147. A second pulley device 161 is fixedly attached to the shaft 107 and which drives an endless belt 163. The screw conveyor means 91 includes a shaft 165 and a pulley device 167 which are rotatably driven in the direction of an arrow 169 by the endless belt 163 as clearly shown in FIG. 2.

The principle of operation will now be disclosed. The cotton 15 enters the apparatus 11 through the entry duct means 25 and is forced toward the front panel 43 by air pressure which may be generated from other apparatus, e.g., cotton cleaning apparatus as well as from air emanating from the nozzle 83. The cotton 15 passes downwardly with the flow of air to the cylinder-like serrated kicker means 27. The air passes between the serrated disks **59*a*, 59*b*, 59*c*, etc., and between the finger grids 61 into the first outlet duct means 31. Small trash particles and motes conveyed by the air particles and motes conveyed by the air exhaust into the first outlet ducts means 31.**

As the locks of cotton 15 contact the kicker means 27, which is rotating to direct the cotton 15 onto the teeth 55 of the ginning saw cylinder 21, the cotton 15 is agitated to shake out fine trash. The cotton fiber engages the saw teeth 55 and is lifted away from the kicker means 27. The cotton 15 is now brought into contact with the spiral shaped ginning roller means 35 as the ginning saw cylinder 21 rotates. The ginning roller 35 has several conveyor type flights or vanes **69*a*, 69*b*, 69*c*, etc., secured to the center tube with the flights conveying from both the left and right ends 63, 65 toward the midsection 67. The flights 69*a*, 69*b*, 69*c*, etc., are staggered so that the ends at midsection 67 will discharge freely. The seeds 13 are deflected away from the fiber which is engaged by the saw teeth 55. The gin roller 35 rotates with a surface speed faster than the surface speed of the ginning saw cylinder 21. The multiple flights or vanes 69*a*, 69*b*, 69*c* present a continuous barrier to the seed cotton 15 being moved by the ginning saw cylinder 21. The teeth 51 of the ginning saw cylinder 21 have a continuous pull on the fiber as the ginning saw cylinder 21 rotates. Between these two counteractions upon the fiber and seed, the seeds 13 are separated from the fiber 15' which continues to move with the saw teeth 55 toward the doffing means 39. The seeds 13 which have been separated from the fiber 15' are deflected and forced away from the ginning saw cylinder 21 by incoming seed cotton 15 on the ginning saw cylinder 21 and by the rotary movement of the vanes 69*a*, 69*b*, 69*c* on the ginning roller 35. The ginned seeds 13, i.e., those which have been separated from the lint cotton 15', fall back to the serrated kicker means 27. Thus, the agitation affect of the teeth 57 (on the kicker means 27) separate ginned seeds from incoming seed cotton 15 (the cotton 15 is being directed to the teeth 55 in the manner previously described). As the seeds 13 have been cleaned of fibers they will then pass through the elongated gap 89 thence move into the screw conveyor means 91 for ultimate discharge through the second outlet duct means 85.**

The apparatus 11 includes a stripper bar 171 which extends between the side panels 47, 49 and which is disposed adjacent the ginning saw cylinder 21 and the ginning roller means 35. From FIG. 1 of the drawings it may clearly be seen that the stripper bar 171 is generally triangular shaped in cross section. More specifically, the stripper bar 171 has a portion thereof, as at 173, contoured for close clearance with the teeth 55 and a portion thereof, as at 175, contoured for close clearance with the vanes 69, 69*a*, 69*b*, 69*c*, etc. It should also be pointed out that the stripper bar 171 has a knifelike leading edge, as at 177, which acts as a cleaning unit and also deflects any seeds which may pass the ginning roller means 35 back into the airstream moving in the direction of the arrows 77.

The air manifold means 81 is the air supply duct for the air nozzle means 83. The air nozzle means 83 spans the total length of the ginning saw cylinder 21 forcing air into the fibers engaged with the saw teeth 55 and dislodging mote, pepper trash, and other small particles of foreign material that might be detrimental to the quality of lint cotton 15'.

It must be emphasized that the air washing means 75 is a lint fiber cleaning system and may be used as an entity or independent of the apparatus 11 if desired. The foreign material dislodged from the fiber by the air pressure wash means 75 is forced toward the front panel 43 and is carried by the airstream through the finger-like grid means 33 where it passes into the first outlet duct means 31.

The lint cotton fibers 15' continue to rotate with the teeth 55 to the point of discharge where the doffing means 39 doffs the lint cotton 15' from the teeth 55 and forces the ginned lint cotton 15' to discharge from the machine by air pressure which is either generated by the revolving brush shown in FIG. 1 of the drawings or by other suitable doffing means alluded to above, i.e., air pressure doffing means or the like. It should be mentioned that the doffing means 39 as depicted in the drawings includes a revolving brush cylinder 179 and shroud means 181 disposed circumjacent to the brush cylinder 179. The shroud means 181 is preferably provided with a pair of openings 183, 185 to enhance the ability of the brush cylinder 179 to generate a sufficient volume of air to not only doff the lint cotton 15' from the teeth 55 but to also convey the lint cotton 15' through the lint cotton duct means 41, i.e., the openings 183, 185 provide inlets for this induced air.

An important feature of the present invention is that the ginning action is on the surface of the ginning saw cylinder 21. This is believed to be a totally new concept in the state of the art of cotton gins.

Although the invention has been described and illustrated with respect to a preferred embodiment thereof, it is to be understood that it is not to be so limited since changes and modifications may be made therein which are within the full intended scope of the invention.

I claim:

1. Apparatus for removing and segregating seeds from seed cotton, said apparatus comprising frame-like housing means, a prime mover for rotatably driving certain structure of said apparatus, a ginning saw cylinder for engaging and holding the fibers of the seed cotton, said ginning saw cylinder being journaled to said housing means and being coupled to said prime mover for rotation in a predetermined direction about a horizonatal axis, entry duct means disposed adjacent said ginning saw cylinder for admitting the seed cotton into said housing means, cylinder-like kicker means disposed within said housing means and extending across the path of the seed cotton being admitted therein for agitating and directing the seed cotton onto said ginning saw cylinder, said kicker means being journaled to said housing means and being coupled to said prime mover for rotation in a predetermined direction about a horizontal axis, first outlet duct means leading outwardly from said housing means for receiving and discharging at least a first portion of the seeds which have been removed from the seed cotton, grid means interposed between said entry duct means and said first outlet duct means for preventing passage into said first outlet duct means of the locks of cotton and for permitting passage therethrough of the segregated seeds, spiral shaped ginning roller means coacting with said ginning saw cylinder for engaging and removing the seeds from the seed cotton, said ginning roller means being journaled to said housing means and being coupled to said prime mover for rotation in a predetermined direction about a horizontal axis with the periphery thereof being a predetermined distance from the periphery of said ginning saw cylinder, doffing means for subsequently removing the lint cotton from said ginning saw cylinder, and lint cotton duct means leading outwardly from said housing means for receiving the lint cotton from said doffing means and for directing the lint cotton to further processing apparatus.

2. The apparatus as set forth in claim 1 in which is included deflector means interposed between said entry duct means and said ginning saw cylinder for deflecting the locks of seed cotton entering through said entry duct means to be caused to move along a prescribed path, said housing means having a substantially disposed front plate member, said deflector means being effective to cause the prescribed path of the locks of cotton to be disposed adjacent said front plate member and at a spaced distance away from said ginning saw cylinder thus precluding coadunation of the incoming seed cotton with the seed free lint cotton being held by said ginning saw cylinder.

3. The apparatus as set forth in claim 1 in which is included air pressure wash means for dislodging certain foreign material from the seed free lint being held by said ginning saw cylinder, said air pressure wash means also establishing a mass of rushing air for aiding in conveying the seed cotton along a prescribed path and for aiding in conveying the first portion of the seeds through said grid means for ultimate discharge outwardly through said first outlet duct means.

4. The apparatus as set forth in claim 3 in which said air pressure wash means includes a source of air pressure, manifold means communicated with said source of air pressure, and nozzle means communicated with said manifold means, said nozzle means being arranged to direct the air emanating therefrom against the circumferential surface of said ginning saw cylinder whereby the locks of seed free cotton being held thereon are air washed, the flow of air from said nozzle means being directed to flow in a direction which is opposite from the direction of travel of the surface of said ginning saw cylinder.

5. The apparatus as set forth in claim 1 in which is included second outlet duct means leading outwardly from said housing means for discharging at least a second portion of the seeds which have been removed from the seed cotton, and bypass means communicated with said second outlet duct means for receiving the second portion of the segregated seeds from said kicker means and for introducing these seeds to said second outlet duct means, said kicker means being disposed a predetermined spaced apart distance from said ginning saw cylinder with the generatrices thereof jointly defining at least in part an elongated gap, said bypass means being disposed subjacent to and communicated with said elongated gap whereby the loose seeds which enter into said gap gravitate downwardly between said ginning saw cylinder and said kicker means thus entering said bypass means for ultimate discharge through said second outlet duct means.

6. The apparatus as set forth in claim 5 in which is included screw conveyor means disposed adjacent said bypass means for laterally moving the second portion of seeds into said second outlet duct means, said screw conveyor means being journaled to said housing means and being coupled to said prime mover for rotation in a predetermined direction about a horizonatal axis.

7. The apparatus as set forth in claim 5 in which is included means for adjusting the effectiveness of said kicker means, wherey seeds of various sizes may selectively pass between said ginning saw cylinder and said kicker means.

8. Apparatus for removing and segregating seeds from seed cotton said apparatus comprising frame-like housing means having a front plate member, a prime mover for rotatably driving certain structure of said apparatus, a ginning saw cylinder for engaging and holding the seed cotton, said ginning saw cylinder being journaled to said housing means and being coupled to said prime mover for rotation in a predetermined direction about a horizonatal axis, entry duct means disposed adjacent said ginning saw cylinder for admitting the seed cotton into said housing means, cylinder-like kicker means disposed within said housing means and extending across the path of the seed cotton being admitted therein for agitating and directing the seed cotton onto said ginning saw cylinder, siad kicker means being journaled to said housing means and being coupled to said prime mover for rotation in a predetermined direction about a horizontal axis, deflector means interposed between said entry duct means and said ginning saw cylinder for deflecting the locks of seed cotton entering through said entry duct means to be caused to move along a prescribed path in proximity to said front plate member and at a spaced distance from said ginning saw cylinder, means for air washing and dislodging certain foreign material from the seed free lint including means for directing a continuous blast of air pressure against the surface of said ginning saw cylinder, first outlet duct means leading outwardly from said housing means for receiving and discharging at least a first portion of the seeds which have been removed from the seed cotton, grid means interposed between said entry duct means and said first outlet duct means for preventing passage into said first outlet duct means of the locks of cotton and for permitting pressure therethrough of the segregated seeds, spiral shaped ginning roller means coating with said ginning saw cylinder for engaging and removing the seeds from the seed cotton, said ginning roller means being journaled to said housing means and being coupled to said prime mover for rotation in a predetermined direction about a horizontal axis with the periphery thereof being a predetermined distance from the periphery of said ginning saw cylinder to enable said ginning roller means to engage and pull the seeds from the locks of cotton which remain attached to and are continuously being pulled by said ginning saw cylinder, second outlet duct means leading outwardly from said housing means for discharging at least a second portion of the seeds which have been removed from the seed cotton, bypass means communicated with said second outlet duct means for receiving the second portion of the segregated seeds from said kicker means and for introducing these seeds to said second outlet duct means, said kicker means being disposed a predetermined spaced apart distance from said ginning saw cylinder with the generatrices thereof jointly defining at least in part an elongated gap, said bypass means being disposed subjacent to and communicated with said elongated gap whereby the loose seeds which enter into said gap gravitate downwardly between the ginning saw cylinder and said kicker means, doffing means for subsequently removing the lint cotton from said ginning saw cylinder, and lint cotton duct means leading outwardly from said housing means for receiving the lint cotton from said doffing means and for directing the lint cotton to further processing apparatus.

9. The apparatus as set forth in claim 8 in which is included screw conveyor means disposed adjacent said bypass means for laterally moving the second portion of seeds into said second outlet duct means, said screw conveyor means being journaled to said housing means and being coupled to said prime mover for rotation in a predetermined direction about a horizontal axis.

10. The apparatus as set forth in claim 8 in which is included means for adjusting the width of said elongated gap to permit optimum regulation for various types and sizes of seeds which pass between said ginning saw cylinder and said kicker means.

11. The apparatus as set forth in claim 1 in which is included stripper bar means extending parallel with the rotating axis of said ginning saw cylinder and being adjacent said ginning saw cylinder and said ginning roller means, said stripper bar being generally triangular shaped in cross-section, a first portion of said stripper bar means being contoured for close clearance with the outer periiphery of said ginning saw cylinder, and a second portion of said stripper bar means being contoured for close clearance with the outer periphery of said ginning roller means.

12. The apparatus as set forth in claim 11 in which said stripper bar means includes a knifelike leading edge thus establishing a cleaning unit, said knifelike leading edge deflecting seeds which may pass said ginning roller means for ultimate discharge thereof through said first outlet duct means.

* * * * *